US006491263B1

(12) United States Patent
Sung et al.

(10) Patent No.: US 6,491,263 B1
(45) Date of Patent: Dec. 10, 2002

(54) POWER SUPPLY UNIT AND RAIL SWITCHING MECHANISM FOR MODEL TRACK LAYOUTS

(75) Inventors: Ki Ho Sung, Seoul (KR); Seung-Bum Kim, Seoul (KR)

(73) Assignee: Mike's Train House, Inc., Columbia, MD (US)

( * ) Notice: Subject to any disclaimer, the term of this patent is extended or adjusted under 35 U.S.C. 154(b) by 0 days.

(21) Appl. No.: 09/902,465

(22) Filed: Jul. 11, 2001

Related U.S. Application Data

(60) Provisional application No. 60/217,481, filed on Jul. 11, 2000.

(51) Int. Cl.[7] ..... B61L 5/06

(52) U.S. Cl. ..... 246/415 R; 246/221

(58) Field of Search ..... 246/415 A, 221, 246/225, 231; 33/288, 287

(56) References Cited

U.S. PATENT DOCUMENTS 1,548,940 A * 8/1925 Gill ..... 246/415 A
1,567,047 A * 12/1925 Forchheimer ..... 246/415 A
1,709,206 A * 4/1929 Craft ..... 246/225
1,883,090 A * 10/1932 Tafel ..... 246/221
2,615,125 A * 10/1952 Peabody ..... 246/236
4,355,776 A * 10/1982 Rydin ..... 246/219
4,917,649 A * 4/1990 Tammera ..... 238/10 F

* cited by examiner

*Primary Examiner*—S. Joseph Morano
*Assistant Examiner*—Frantz F. Jules
(74) *Attorney, Agent, or Firm*—McDermott, Will & Emery

(57) ABSTRACT

A distinct power terminal that is independently releasably fitted within a support member of the model track layout. The power terminal is coupled to an external power source through lead wires. The power terminal includes "cave-in" parts at opposing ends of the power terminal which are snap-fit into corresponding openings of the support member. The support member includes side openings to allow the lead wires to extend from the power terminal outwards to the external power source. The power terminal further includes connecting terminals that couple the electric power from the power terminal to the track rails. In addition, a rail converting switch includes two solenoid drivers with corresponding stroke axles positioned on opposing sides of a housing. The stroke axles are connected to a sliding part positioned between the stroke axles, which sliding part includes a supporting axle and connection portion for coupling to, and actuating, a rail coupler. The sliding part further includes a body part which provides therein two springs for buffering movement between the body part and the supporting axle.

27 Claims, 7 Drawing Sheets

POWER SUPPLY UNIT AND RAIL SWITCHING MECHANISM FOR MODEL TRACK LAYOUTS

RELATED APPLICATIONS

This application claims priority from U.S. Provisional Application No. 60/217,481, filed Jul. 11, 2000, incorporated herein by reference.

FIELD OF THE INVENTION

The present invention is directed to a power supply unit for supplying power to a model track layout and a rail switching mechanism for effecting switching between rails of the model track layout.

BACKGROUND OF THE INVENTION

FIG. 1 illustrates a conventional model track layout 1 (e.g., train track). The trains (not shown) are powered to run on the track 1 using one of the following two methods: (1) providing the individual trains with a power source (e.g., battery) therein to drive the train's motor for rotating the wheels or (2) providing an external power supply 2 which supplies power to each of the track rails (1*a*, 1*b*, 1*c*), which power is then picked up by the wheels/rollers of the train and supplied to the motor for rotating the wheels.

In the second method (i.e., providing power to the track rails 1*a*, 1*b*, 1*c*), the conventional set-up has several disadvantages. FIG. 2 shows a close-up view of a track illustrating the electrical connections made between the power source 2 and the track rails 1*a*, 1*b*, 1*c*. Each of the rails 1*a*, 1*b*, 1*c* is coupled to equally spaced support members 23, which support members 23 run perpendicular to each of rails 1*a*, 1*b*, 1*c*. Extending from the power source 2 (not shown in FIG. 2) are three connecting wires 3*a*, 3*b*, 3*c* which couple the track rails 1*a*, 1*b*, 1*c* to the power source 2.

The connecting wires 3*a*, 3*b*, 3*c* are soldered to, and thereby fixed to, each of track rails 1*a*, 1*b*, 1*c*, respectively. This conventional set-up for coupling the power from power source 2 to the track rails 1*a*, 1*b*, 1*c* is not satisfactory. Accordingly, there exists a need in the art for an improved connection between a power source and track rails.

In particular, the conventional set-up requires a user to break off and re-solder the connecting wires 3*a*, 3*b*, 3*c* to the track rails 1*a*, 1*b*, 1*c* every time he/she wants to assemble or disassemble the track layout 1. This causes wear and tear on the connecting wires 3*a*, 3*b*, 3*c*. Further, the soldering step requires the additional tools of solder material and a heating gun. Not only does this add cost and impracticality, but it increases the chance of injury to a child who may burn him/herself with the heating gun.

Even further, because the connecting wires 3*a*, 3*b*, 3*c* must be connected to each track rail 1*a*, 1*b*, 1*c*, respectively, the connecting wires 3*a*, 3*b*, 3*c* must be spread out over a wider distance in order to provide adequate spacing between respective wires to reduce the chances of entanglement. Even with wider spacing, which leads to an unseemly and unattractive appearance, tangling of the wires is inevitable because of the fact that each wire is connected to a separate and distinct track rail thereby promoting independent movement between the wires. Such spacing adds further risk to children who may trip and fall over the space-dominating wires. Moreover, the unkept wiring can interfere with vehicle operation when it unintentionally runs over the track rails and thereby tangles with the vehicle's wheels.

Furthermore, the connecting wires 3*a*, 3*b*, 3*c* are vulnerable to becoming unintentionally disconnected from minimal tension that may be asserted, for example, if the wires are pulled or stretched to adjust their positioning, or, if someone accidentally catches the wires with their feet when walking by.

Accordingly, there is a need in the art for a simple, convenient mechanism for supplying power to a track layout that is practical, safe for children, easy to connect/disconnect while maintaining stability, and exudes a neat, professional appearance.

Another aspect of prior art model track layouts that has incurred problems is the rail switching mechanism utilized to effect track switching at intersections. A model track layout using a rail switching mechanism will typically include a main rail that is provided with two direction converting rails. The two direction converting rails are selectively switched onto/off the main rail. A rail coupler connects the pair of direction converting track rails and is held on the main rail. The rail coupler is actuated by a rail converting switch so that it moves between two distinct positions such that the path the model train will take from the main rail is switched between two alternative track rails extending from the main rail.

However, in prior art constructions, the rail converting switch takes up too much space due to inadequate design of the mechanical interrelationship between the moving parts of the switch and the power source that drives the moving parts. Further, prior art constructions are rigidly constructed so that impact on the various parts of the switch resulting from continuous engagement between the switch and the coupler may cause wear and tear, thereby reducing the life of the parts. Forceful impacts could cause the coupler and the switch to unintentionally uncouple, therefore reducing the reliability of the switch. Even further, prior art designs lack an energy absorption means to absorb the energy resulting from impact forces between the direction converting rails and the main rail. Such energy can lead to excessive play between the main rail and the direction converting rails so that they are not fully aligned, which play will inhibit trains from smoothly riding through an intersection.

Accordingly, there is a need in the art for a compact, space-saving rail switching mechanism that absorbs impact on its respective parts during operation so that a reliable switching operation takes place.

SUMMARY OF THE INVENTION

One object of the present invention is to provide an improved power supply mechanism for supplying voltage to a model track layout that is easily replaceable and exudes a neat appearance.

A further object of the present invention is to provide a compact, space-saving rail converting switch that is fully operational.

A still further object of the present invention is to provide an improved rail converting switch that absorbs impact force on the various components of the rail converting switch during switching operations.

In one exemplary embodiment of the novel power supply unit, the present invention provides a distinct power terminal that is independently releasably fitted within a support member of the model track layout. The power terminal is coupled to an external power source through lead wires. The power terminal includes "cave-in" parts at opposing ends of the power terminal which are snap-fit into corresponding openings of the support member. The support member includes side openings to allow the lead wires to extend from the power terminal outwards to the external power source.

The power terminal further includes connecting terminals that couple the electric power from the external power source to the track rails. In such a construction, the power terminal is easily replaceable without dependence on external tools or adhesives.

In one exemplary embodiment of the novel rail converting switch, the present invention provides two solenoid drivers with corresponding stroke axles positioned on opposing sides of a housing. The stroke axles are connected to a sliding part positioned between the stroke axles, which sliding part includes a supporting axle and connection portion for coupling to, and actuating, a rail coupler. The sliding part further includes a body part which provides therein two springs for buffering movement between the body part and the supporting axle. In such a construction, the rail converting switch provides the required functionality with minimal space while eliminating impact forces, thereby increasing reliability.

DETAILED DESCRIPTION OF PREFERRED EMBODIMENTS

Figure 1:
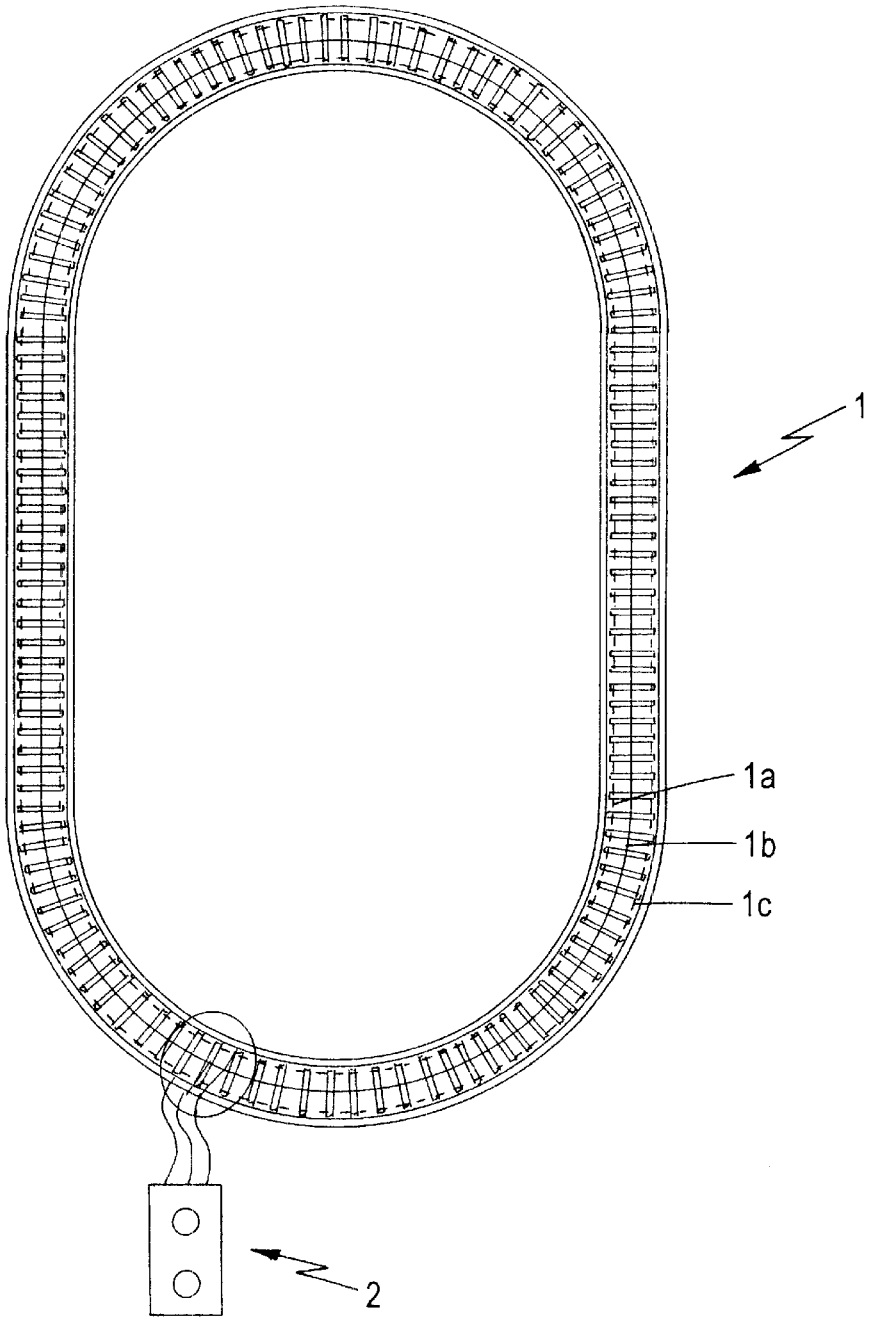
FIG. 1 (PRIOR ART)
FIG. 1 shows a conventional power supply for a model track layout.
Figure 2:
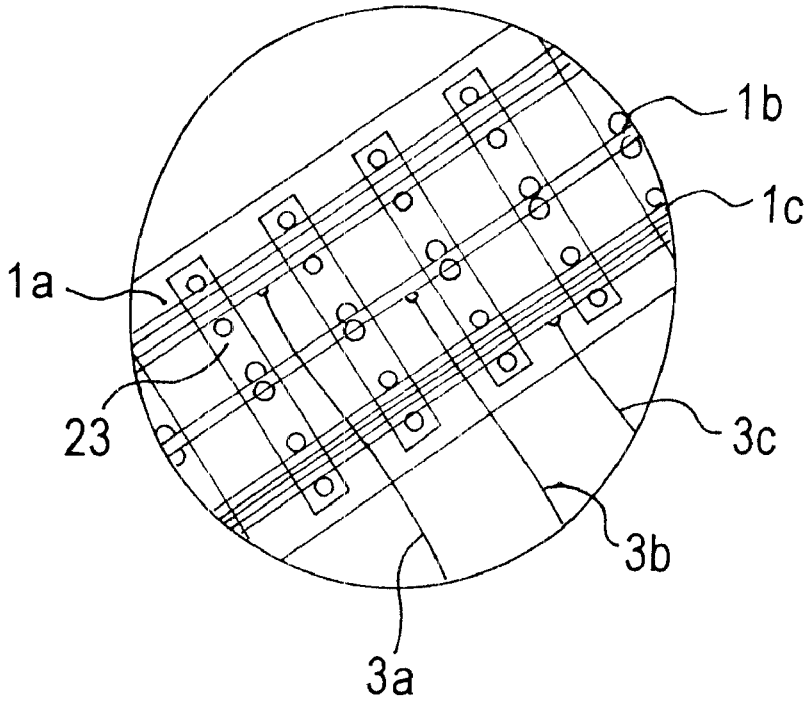
FIG. 2 (PRIOR ART)
FIG. 2 shows a close-up of a cut-out portion of FIG. 1.
Figure 3:
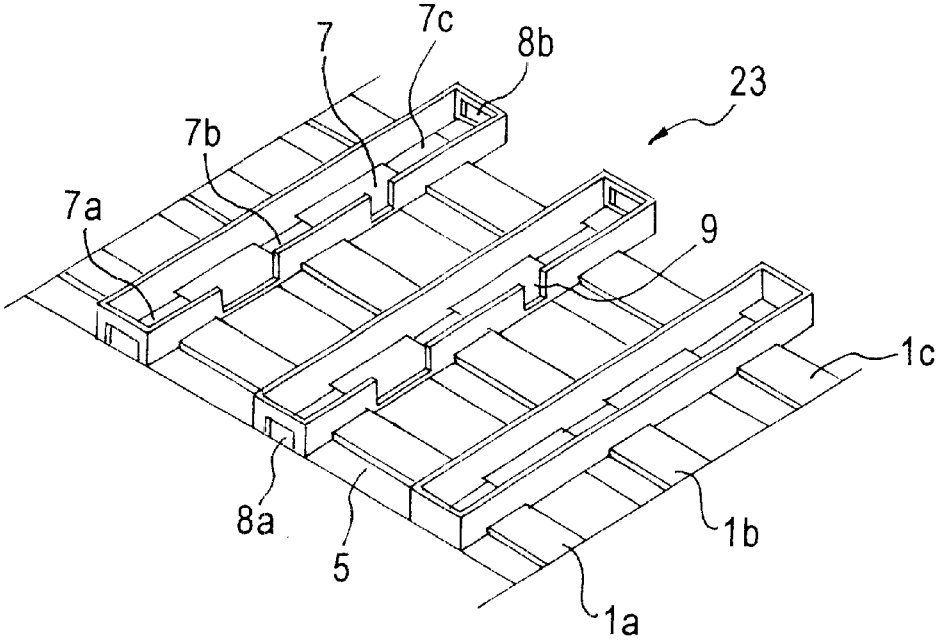
FIG. 3 shows one exemplary embodiment of the novel support member of the present invention.
Figure 6:
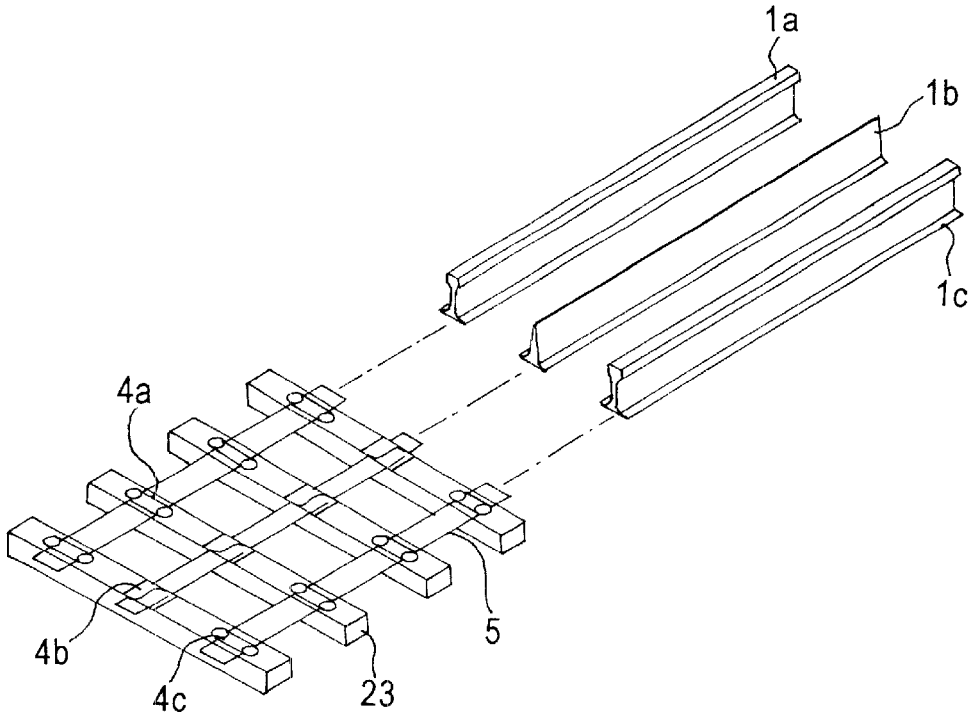
FIG. 6 shows the relative positioning of the track rails with respect to the support members.

FIG. 3 illustrates the interconnection between the track rails 1*a*, 1*b*, 1*c* and the support members 23 in one exemplary embodiment of the present invention. The support members 23 have thereon electrically conducting connecting plates 5 (see also FIG. 6) which run perpendicular to the support members 23 in the direction of the track rails 1*a*, 1*b*, 1*c*. The connecting plates 5 co-act with the track rails 1*a*, 1*b*, 1*c* in a known manner (e.g., sliding fit) such that the track rails 1*a*, 1*b*, 1*c* are capable of being integrally coupled with the connecting plates 5 and thereby fixed to the support members 23. Although three track rails 1*a*, 1*b*, 1*c* are shown, it should be appreciated that any number of track rails can be utilized corresponding to the particular model vehicle to be driven thereon. In addition, one of the track rails can function as an isolated power pick-up line which co-acts with a roller located underneath a model vehicle.

The features of the novel support member 23 of the present invention will now be discussed. In the illustrated embodiment, the support member 23 defines a generally rectangular box with two side surfaces and two end surfaces, and an open top (top as viewed from FIG. 3). The bottom surface 7 of the support member 23 includes three openings 7*a*, 7*b*, 7*c*. It should be appreciated that any shape and configuration for the support members 23 can be used to effect the benefits of the present invention (e.g., circular, square, ellipse, triangular, etc.). Each of the end surfaces of the support member 23 defines a hole 8*a*, 8*b* thereon, respectively. In addition, at least one of the two side surfaces include cut-out portion(s) 9. The functionality of the openings 7*a*, 7*b*, 7*c*, holes 8*a*, 8*b*, and cut-out portion(s) 9 will be discussed further below.

Figure 4:
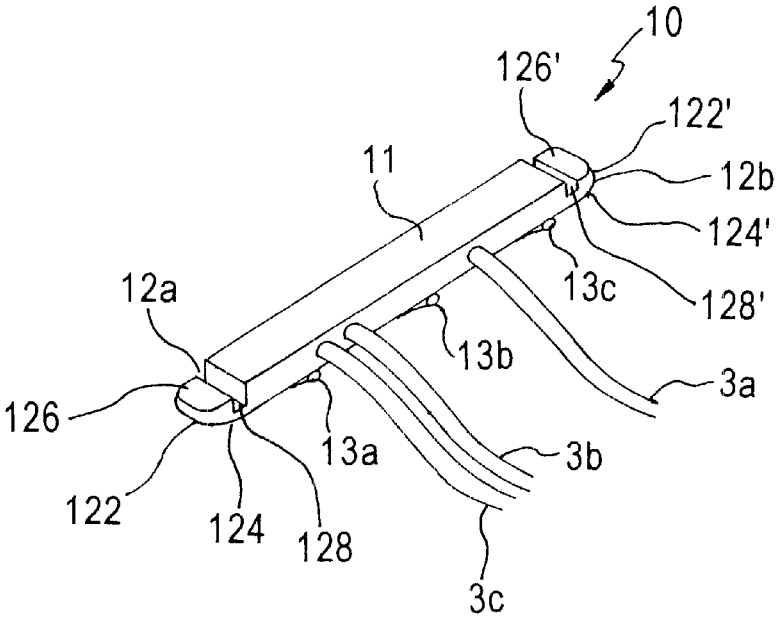
FIG. 4 shows one exemplary embodiment of the novel power terminal of the present invention.

Turning to FIG. 4, one exemplary embodiment of an electric power terminal 10 of the present invention will now be discussed. The electric power terminal 10 includes a non-conductor body 11, "cave-in" ends 12*a*, 12*b*, connecting terminals 13*a*, 13*b*, 13*c* and lead wires 3*a*, 3*b*, 3*c*. The electric power terminal 10 is coupled to a power source (not shown) via lead wires 3*a*, 3*b*, 3*c*. The connecting terminals 13*a*, 13*b*, 13*c* correspond to the track rails 1*a*, 1*b*, 1*c*, respectively. The connecting terminals 13*a*, 13*b*, 13*c* function to couple the power supplied from the power source (not shown) into the body 11 (with appropriate electrical circuitry therein), and then to the respective track rails 1*a*, 1*b*, 1*c*.

Figure 5:
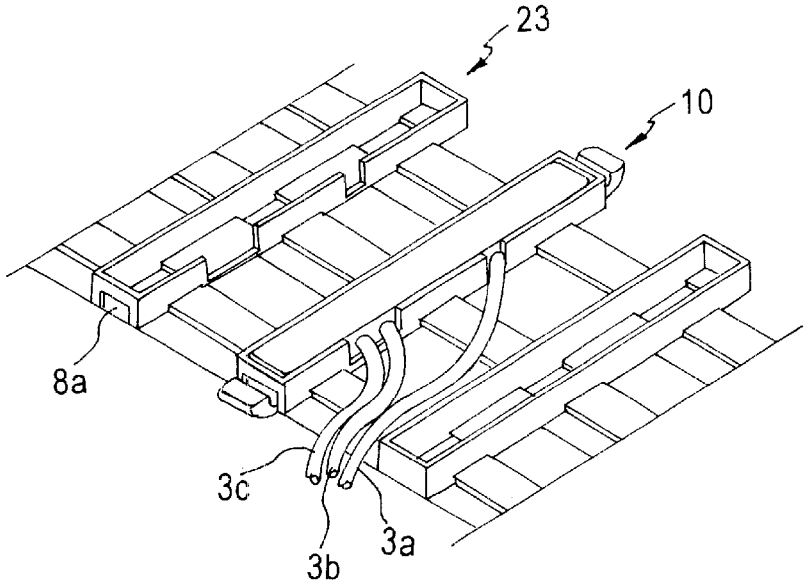
FIG. 5 shows the combination of the novel power terminal coupled to the novel support member of the present invention.

As shown in FIG. 5, an electric power terminal 10 is shaped to fit within one of the support members 23. If more power sources (not shown) are desired to be coupled to the track layout, additional electric power terminals 10 can be positioned within respective support members 23. Returning to FIG. 4, the "cave-in" ends 12*a*, 12*b* each extend from a respective end surface of the body 11 and include a curved surface 122, 122' that extends from a bottom surface 124, 124'. The curved surface 122, 122' extends to a top surface 126, 126' of the "cave-in" ends 12*a*, 12*b*. The top surface 126, 126' is spaced from the end surface so as to define a step or groove 128, 128' between the top surface 126, 126' and the end surface.

Turning to FIG. 5, the novel connection between the electric power terminal 10 and the support member 23 will now be discussed. In particular, one "cave-in" end 12*a*, 12*b* is placed through a respective hole 8*a*, 8*b* of the support member 23 such that the inner edge of hole 8*a*, 8*b* of the support member 23 is fitted within the step or groove 128, 128'. Thereafter, the other "cave-in" end 12*a*, 12*b* can be snap-fit into the other hole 8*a*, 8*b* by pushing the curved surface 122, 122', which functions as a guide surface, against the top edge of the end surface (above the respective hole 8*a*, 8*b*) of the support member 23, thereby guiding the "cave-in" end 12*a*, 12*b* into the hole 8*a*, 8*b*. Accordingly, the electric power terminal 10 is securely fixed to the support member 23.

When the electric power terminal 10 is fitted within the support member 23, the connecting terminals 13*a*, 13*b*, 13*c* (see FIG. 4) extend through openings 7*a*, 7*b*, 7*c*, respectively, and are coupled to connecting plates 5 in order to electrically couple the connecting terminals 13*a*, 13*b*, 13*c* to the rails 1*a*, 1*b*, 1*c*. The openings 7*a*, 7*b*, 7*c* each define a groove sized to fit a connecting plate 5 therein, which plate 5 is held in place by any suitable clamp means 4*a*, 4*b*, 4*c* (see FIG. 6). Thus, the track rails 1*a*, 1*b*, 1*c*, which are positioned on a connecting plate 5, are electrically coupled to the power source. The lead wires 3*a*, 3*b*, 3*c* extending from the electrical terminal 10 are directed through cut-out portion(s) 9 to the power source (not shown).

In order to remove the electric power terminal 10 from the support member 23, one need only push one of the "cave-in" ends 12*a*, 12*b* back through its respective hole 8*a*, 8*b*, at which point the internal pressure will force that end of the electrical power terminal 10 upward guided by the corresponding curved surface 122, 122'. The electrical power terminal 10 can thereafter be easily pulled out from the support member 23.

Accordingly, the present invention provides a power supply mechanism for a model train layout that can be easily connected/reconnected to the model train layout independently of any messy wiring connections and dangerous soldering required in the prior art. That is, the power supply can be coupled or de-coupled from the track without the need to use adhesives (e.g., solder) and/or tools (e.g., soldering equipment) while providing a better aesthetic appearance.

Figure 7:
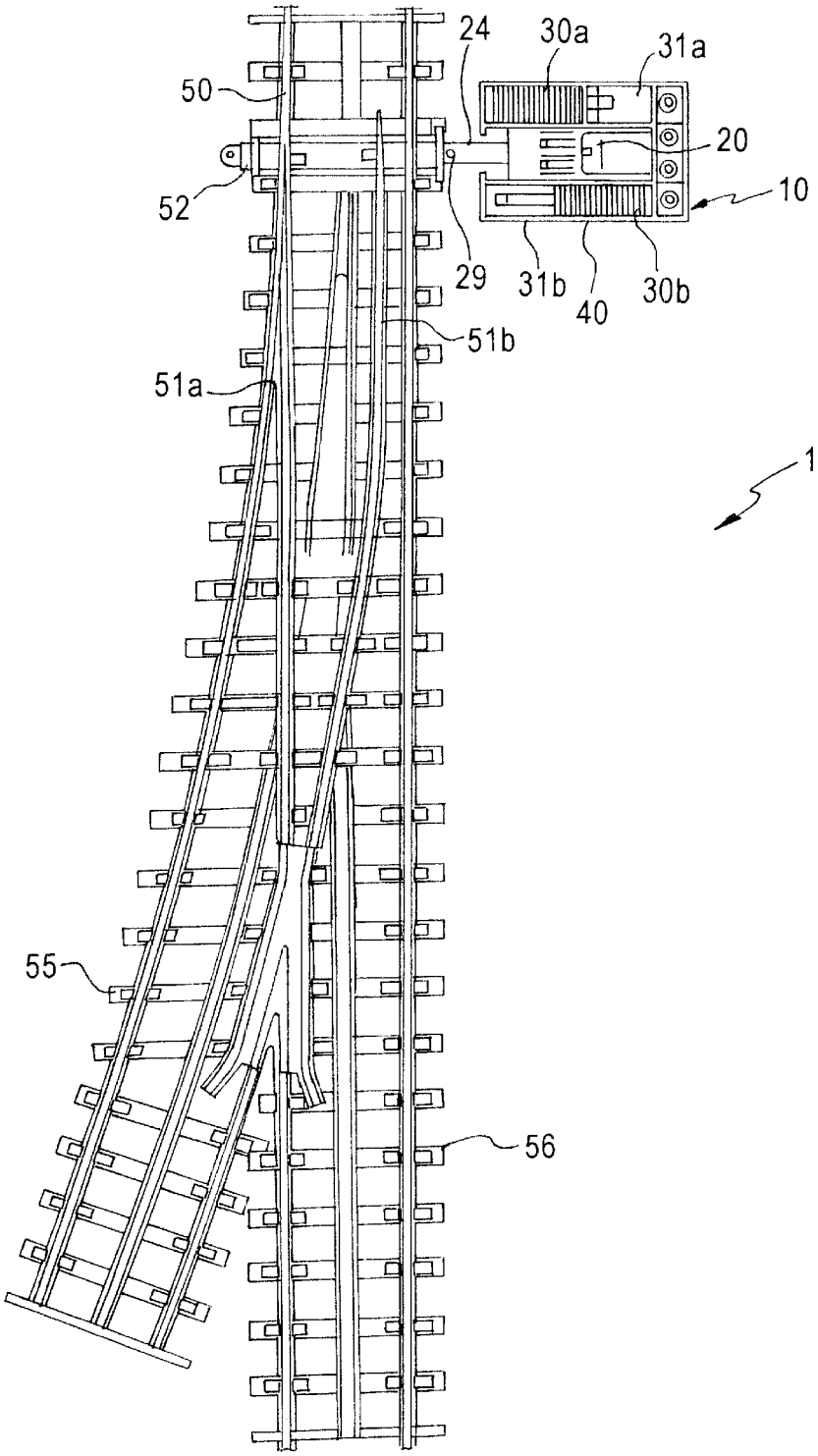
FIG. 7 shows one exemplary embodiment of the novel rail switching mechanism of present invention coupled to a track layout.

Turning to FIG. 7, a novel rail converting switch 10 of the present invention will now be discussed. As shown in FIG. 7, a main rail 50 diverges into two distinct paths defined by rails 55 and 56. The path that a train will take depends on the location of direction converting rails 51*a*, 51*b*. The converting rails 51*a*, 51*b* are coupled to a common rail coupler 52 extending across the track rails. The rail coupler 52 is attached to the rail converting switch 10 through a peg/hole arrangement. In the exemplary embodiment, the rail converting switch 10 moves the rail coupler 52 in a direction generally perpendicular to the track rails in order to effect the switching operation.

In the position shown in FIG. 7, a train coming from the main rail 50 will be directed to the rail 56. That is, the direction converting rail 51*a* is located on the rail 50 while the direction converting rail 51*b* is spaced away from rail 50. Accordingly, the wheels located on the left side of the rail 50 as viewed in FIG. 7 will be directed into direction converting rail 51 a from rail 50 when entering the intersection, and the wheels on the right side of rail 50 will remain in rail 50. As a result, the train will move onto rail 56. If the direction converting rail 51*b* is moved onto the rail 50 (which would simultaneously move direction converting rail 51*a* off of rail 50), the train would move onto rail 55 by virtue of the wheels located on the right side of rail 50 being directed into the direction converting rail 51*b* from rail 50 when entering the intersection, and the wheels on the left side of rail 50 remaining in rail 50 (direction converting rail 51*a* will be spaced away from rail 50 in similar fashion as direction converting rail 51*b* shown in FIG. 7).

The rail converting switch 10 is coupled to the direction converting rails 51*a* and 51*b*, through rail coupler 52, in order to effect the switching between the aforementioned positions. As shown generally in FIG. 7, the rail converting switch 10 includes solenoids 30*a*, 30*b*, stroke axles 31*a*, 31*b*, a sliding part 20, and a base 40. The sliding part 20 includes a supporting axle 24 having a connecting portion 29. The connecting portion 29 is illustrated as a peg that fits into a corresponding hole on the rail coupler 52. Of course, any suitable connection between the supporting axle 24 and the rail coupler 52 can be used.

Figure 8:
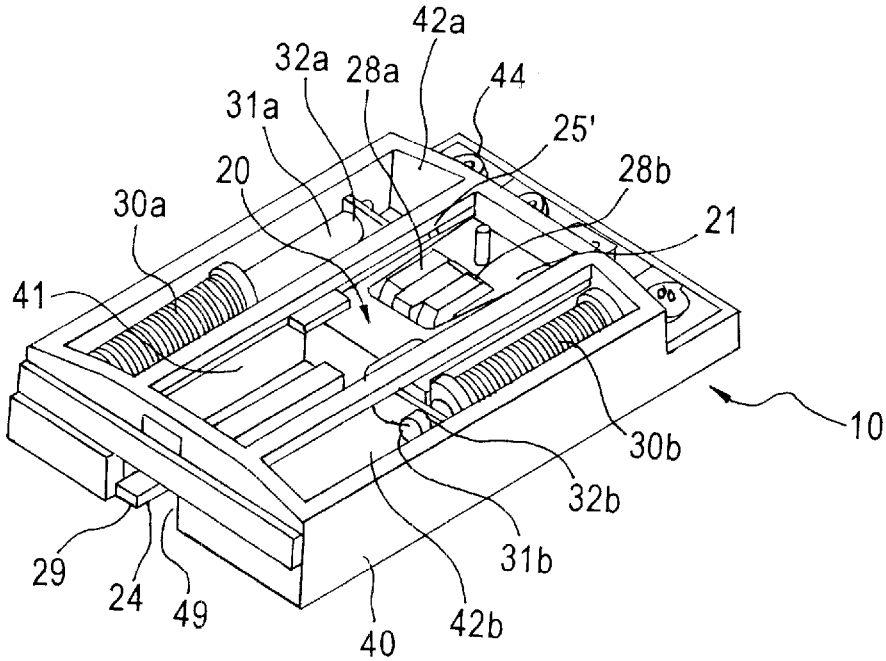
FIG. 8 shows an oblique perspective view of the novel rail switching mechanism and it's internal components.
Figure 9:
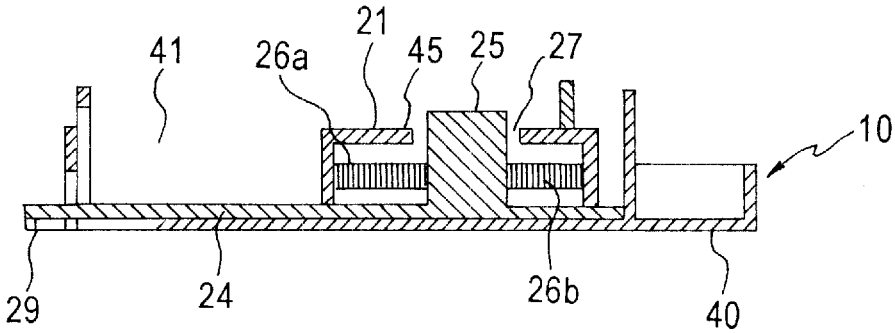
FIG. 9 shows a cross-sectional view of the novel rail switching mechanism of the present invention.
Figure 10:
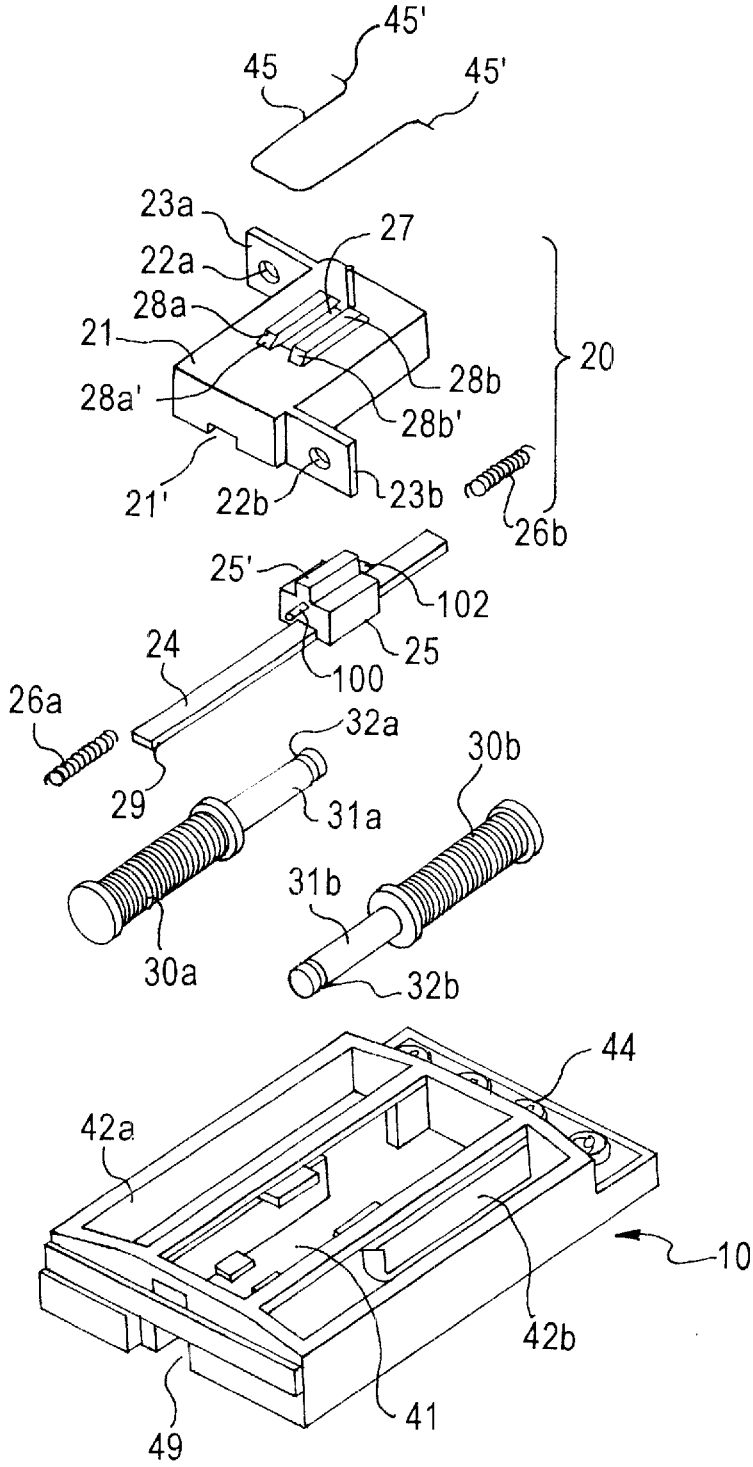
FIG. 10 shows the individual components of the novel rail switching mechanism in a spaced orientation.

Turning to FIGS. 8–10, the structural and functional interactions between the various elements of the rail converting switch 10 will be discussed. As shown in FIG. 8, the base 40 includes a corridor 41 for housing and guiding movement of the sliding part 20. Base 40 further includes corridors 42*a*, 42*b* for housing solenoids 30*a*, 30*b*, respectively, as well as for housing and guiding movement of corresponding stroke axles 31*a*, 31*b*. The front end face of base 40 includes an opening 49 for allowing supporting axle 24 movement therethrough. At the back end of base 40 is an electrical terminal 44 adapted to be connected to any suitable power source (e.g., battery, transformer, etc.). The terminal 44 is electrically coupled to the solenoids 30*a*, 30*b* to provide electric power thereto.

The solenoids 30*a*, 30*b* each have hollow interiors configured to slidably receive a respective stroke axle 31*a*, 31*b* in a manner that allows the stroke axle 31*a*, 31*b* to slide into and out of the hollow interior. The stroke axles 31*a*, 31*b* each have a groove 32*a*, 32*b* formed at one end of the stroke axle for coupling the stroke axle to a body part 21 (see FIG. 10). Body part 21 includes two projecting parts 23*a*, 23*b* extending from opposing ends of the body part 21, one projecting part 23*b* extending from the front end of body part 21 and the other projecting part 23*a* extending from the back end of body part 21. Each projecting part 23*a*, 23*b* includes a hole 22*a*, 22*b* extending therethrough. The solenoids 30*a*, 30*b* are coupled to the body part 21 by fitting stroke axles 31*a*, 31*b* through openings 22*a*, 22*b* until the circumferential edge of openings 22*a*, 22*b* are snap fit into the respective grooves 32*a*, 32*b* of the stroke axles 31*a*, 31*b*. Coupling the solenoids 30*a*, 30*b* to opposing ends of the body part 21 will more efficiently distribute the power from the solenoids 30*a*, 30*b* to the body part 21 to thereby provide a more forceful movement of the supporting axle 24. The movement of supporting axle 24 will therefore more closely correspond to the movement of the rail coupler 52 so that a more reliable switching operation can take place. In combination with the buffering action discussed below, the additional force of a second solenoid being placed on an opposing side of the body part will dramatically reduce the play between the main rail and the direction converting rails.

Looking at FIGS. 9 and 10, formed integrally with the supporting axle 24 is a middle portion 25 with a middle-projecting part 25'. Two pegs 100, 102 extend from side faces of middle portion 25 for guiding springs 26*a*, 26*b* to be connected to the end surfaces of middle portion 25. Body part 21 includes a hollow interior for housing the middle portion 25 and part of the supporting axle 24 therein. Body part 21 further includes an opening 21' on an end face for allowing supporting axle 24 to extend out from the hollow interior.

As shown in FIG. 9, when the supporting axle 24 and middle portion 25 are assembled into the hollow interior of the base part 21, the middle-projecting part 25' extends through an opening 27 on the top surface of body part 21. Middle-projecting part 25' is arranged to be movable within the gap defined by an opening 27 in order to provide a buffer when the rail converting switch 10 is in operation. On opposing sides of the opening 27 there are formed lock-removing projections 28*a*, 28*b*, whose functionality will be discussed below. The lock-removing projections 28*a*, 28*b* include tapered surfaces 28*a'*, 28*b'*. As shown in FIG. 10, a stopper spring 45 forms generally a U-shape with outward flange portions 45'. The outward flange portions 45' are fixedly coupled to the base 40 (e.g., by soldering, or being fitted into holes on a surface of the base, etc.). The stopper spring 45 extends around tapered surfaces 28*a'*, 28*b'* and middle-projecting part 25' so as to lock sliding part 20 in a retracted position (see FIG. 8).

FIG. 9 illustrates a cross-sectional view of the body part 21 and the interconnection of the middle portion 25 within the hollow interior of the body part 21. As previously mentioned, one end of springs 26*a*, 26*b* is connected to a surface of the middle portion 25. Similarly, the opposing end of springs 26*a*, 26*b* is fixedly connected to an inner surface of body part 21 (can be independently connected, or soldered to add strength in the connection; any suitable connection can be used, e.g., placing spring wire into corresponding hole in body part 21/middle portion 25 surfaces). As is apparent from viewing FIG. 9, middle portion 25 is provided with a buffering clearance within opening 27 so that there is buffered relative-movement between the middle portion 25 and the body part 21.

The connecting projection 29 is adapted to fit within a connecting hole of the coupler 52 (see FIG. 7) so that movement of the supporting axle 24 is transmitted to corresponding movement of the coupler 52 to effect the switching operation. In operation, the solenoids 30*a*, 30*b* will be energized via terminal 44 with voltage so that, from the positions shown in FIG. 8, stroke axle 31 a is moved into the hollow interior of should be appreciated that one solenoid can also be used to drive the body part 21, but providing two in the unique configuration laid out by the present inventors (e.g., coupling the solenoids 30*a*, 30*b* to opposing ends of body part 21, with the solenoids 30*a*, 30*b* facing opposite directions) provides a more reliable rail converting switch while minimizing space requirements. The solenoids 30*a*, 30*b* can also be arranged in the same direction; however as previously discussed, arranging them in opposite directions to be coupled to opposing ends of body part 21 provides a more efficient and forceful drive of the body part 21 and supporting axle 24. As a result, the direction converting rails 51*a*, 51*b* connected to the rail coupler 52 will be tightly held against the main rail 50 with minimal play therebetween, thereby providing a more reliable intersection for the trains (or other locomotives) to move across without being thrown off the track because of misalignment of the direction converting rails 51*a*, 51*b* and the rails 50 or 55, 56.

Through the interconnection of stroke axles 31*a*, 31*b* and body part 21, movement of the stroke axles 31*a*, 31*b* forces body part 21 to slide within corridor 41 in a direction away from terminal 44. During this movement, stopper spring 45 is forced to pivot upwardly about its outward flange portions 45' via the tapered surfaces 28*a*', 28*b*' of lock-removing projections 28*a*, 28*b*. Specifically, tapered surfaces 28*a*', 28*b*' act as inclined cam surfaces which move with body part 21 into the stopper ring 45 so as to force stopper ring out of a locking position, thereby allowing the body part 21 to continue movement toward opening 49 as viewed in FIG. 8. Thus, the lock mechanism of the present invention (i.e., stopper spring 45) for preventing unintended movement of the body part 21 by locking it in place can be automatically removed through natural operation of the rail converting switch 10. No manual manipulation is needed. Further, stopper spring 45 can slide back into its locking position when the body part 21 is returned to the position shown in FIG. 8, whereby the stopper spring 45 will be guided into its locking position by lock-removing projections 28*a*, 28*b*. The lock-removing projections 28*a*, 28*b* should extend beyond opening 27 and higher than middle-projection part 25' so as to prevent contact between the stopper ring 45 and the middle-projecting part 25'.

Movement of body part 21 during operation is transmitted to corresponding movement of the stroke axle 24 through the interconnection of springs 26*a*, 26*b* between body part 21 and middle portion 25 so that supporting axle 24 is moved in the same direction as body part 21. In this manner, supporting axle 24 and connecting portion 29 move in and out of opening 49. When desired to connect converting rail 51*a* to rail 50, solenoids 30*a*, 30*b* are energized to move body part 21 through stroke axles 31*a*, 31*b* such that the connection portion 29 forces rail coupler 52 towards the left as viewed in FIG. 7 to thereby firmly connect converting rail 51 a to main rail 50. When desired to connect converting rail 51*b* to main rail 50, the energy to solenoids 30*a*, 30*b* is shut-off via terminal 44 so that return springs (not shown; positioned in the interior of the respective solenoids) force the stroke axles 31*a*, 31*b* back to their previous positions. In lieu of return springs, a second reverse-polarity voltage can be applied to the solenoids 30*a*, 30*b* via terminal 44 to induce a return movement of the stroke axles 31*a*, 31*b*.

The novel dual spring 26*a*, 26*b* arrangement of the present invention provides a buffer for the sliding part 20 by allowing relative movement between the body part 21 and the supporting axle 24 during operation. Therefore, any bounce-back force resulting from the impact between the rails will not transmit to the body part 21, but will be absorbed by the middle portion 25 through supporting axle 24. As shown in FIG. 9, the middle portion 25 which is integrally formed with the supporting axle 24 can move within opening 27 so that impact forces are effectively absorbed. Accordingly, when the direction converting rails 51*a*, 51*b* forcefully impact rail 50 during a switching operation, the resulting shock will be transmitted through supporting axle 24 to middle portion 25, which will absorb the shock through reciprocating movement of middle portion 25 between springs 26*a*, 26*b* within opening 27. After the shock is absorbed, the balanced springs 26*a*, 26*b* will operate the supporting axle 24 to force the direction converting rail 51*a*, 51*b* into a tight coupling with the main rail 50 to equate the forces across the middle portion in relation to the relative positioning of the body part 21 and middle portion 25.

As shown in FIG. 9, middle projecting part 25' extends above opening 27 so as to limit movement of the middle portion 25. The buffer provided by the dual springs 26*a*, 26*b* enables a close adherence between main rail 50 and the respective direction converting rail 51*a*, 51*b*, thereby providing a more reliable rail converting switch. Of course, a single spring can also be used for a more limited buffering action.

Accordingly, the present invention provide a rail converting switch that is advantageously compact, while providing a shock absorbing function whereby a tight fit between the main rail and converting rails can be maintained.

Although certain specific embodiments of the present invention have been disclosed, it is noted that the present invention may be embodied in other forms without departing from the spirit or essential characteristics thereof. The present embodiments are therefore to be considered in all respects as illustrative and not restrictive, the scope of the invention being indicated by the appended claims, and all changes that come within the meaning and range of equivalency of the claims are therefore intended to be embraced therein.

We claim:

1. A rail converting switch for a model track layout, comprising:

a body part;

a supporting axle coupled to said body part, said supporting axle adapted to be connected to a rail coupler; and a moving mechanism coupled to said body part, said moving mechanism for moving said body part, wherein said supporting axle is configured to be movable relative to said body part, further comprising a base, said base including a first corridor housing said body part, wherein said first corridor guides movement of said body part.

2. The rail converting switch of claim 1, further comprising a stopper spring, said stopper spring configured to lock said body part in a first position when said body part is stationary and to automatically release said body part when said body part moves.

3. The rail converting switch of claim 1, wherein said rail coupler is adapted to be slidably held on said model track layout.

4. The rail converting switch of claim 3, wherein said model track layout includes a main rail, a first direction rail and a second direction rail, said rail coupler sliding between a first position where said first direction rail is aligned with said main rail and a second position where said second direction rail is aligned with said main rail.

5. The rail converting switch of claim 1, wherein said base includes a second corridor separated from said first corridor by a wall portion, said moving mechanism including a moving member housed in said second corridor and coupled to said body part through an opening of said wall portion such that movement of said moving member forces a corresponding movement of said body part.

6. The rail converting switch of claim 5, wherein said first corridor is arranged adjacent to said second corridor, said moving member and said body part move along a longitudinal axis of said base in the same direction.

7. The rail converting switch of claim 5, wherein said moving mechanism further includes a solenoid for driving said moving member so that said moving member moves into or out of a hollow interior of said solenoid.

8. The rail converting switch of claim 5, wherein said body part includes a flange extending from a first end of said body part with a hole extending therethrough, said moving member having an end portion fitted through said hole for coupling said body part to said moving mechanism.

9. The rail converting switch of claim 5, wherein said base includes a third corridor separated from said first corridor by a wall portion, said moving mechanism including a second moving member housed in said third corridor and coupled to said body part through an opening of said wall portion such that movement of said second moving member forces a corresponding movement of said body part.

10. The rail converting switch of claim 9, wherein said first corridor is arranged adjacent to said third corridor, said second moving member and said body part move along a longitudinal axis of said base in the same direction.

11. The rail converting switch of claim 9, wherein said moving mechanism further includes a second solenoid for energizing said second moving member so that said second moving member moves into or out of a hollow interior of said second solenoid.

12. The rail converting switch of claim 9, wherein said body part includes a first flange extending from a first end of said body part with a hole extending therethrough, said moving member having a first end portion fitted through said hole for coupling said body part to said moving mechanism, and wherein said body part includes a second flange extending outward from a second end of said body part opposite said first end with a second hole extending therethrough, said second moving member having a second end portion fitted through said second hole for coupling said body part to said moving mechanism.

13. The rail converting switch of claim 9, wherein said first corridor is positioned between said second and third corridor.

14. A rail converting switch for a model track layout, comprising:

a body part;

a supporting axle coupled to said body part, said supporting axle adapted to be connected to a rail coupler; and a moving mechanism coupled to said body part, said moving mechanism for moving said body part, wherein said supporting axle is configured to be movable relative to said body part, wherein said body part includes a hollow interior and said supporting axle includes a middle portion extending within said hollow interior.

15. The rail converting switch of claim 14, further including a first spring, said first spring having one end coupled to an inner surface of said body part and another end coupled to said middle portion.

16. The rail converting switch of claim 15, further including a second spring, said second spring having one end coupled to an inner surface of said body part and another end coupled to said middle portion such that said middle portion is positioned between said first and second spring.

17. The rail converting switch of claim 14, wherein said body part includes a top surface with an opening therethrough, said middle portion including a projection extending through said opening.

18. A rail converting switch for a model track layout, comprising:

a body part;

a supporting axle coupled to said body part, said supporting axle adapted to be connected to a rail coupler; and a moving mechanism coupled to said body part, said moving mechanism for moving said body part, wherein said supporting axle is configured to be movable relative to said body part, said rail converting switch further comprising a stopper spring, said stopper spring configured to lock said body part in a first position when said body part is stationary and to automatically release said body part when said body part moves, said rail converting switch further comprising at least one projection extending from a top surface of said body part, said at least one projection configured to co-act with said stopper spring during movement of said body part from said first position to effect unlocking of said body part from said first position.

19. The rail converting switch of claim 18, wherein said at least one projection includes a tapered surface for slidably engaging said stopper spring to effect pivoting of said stopper spring.

20. A rail converting switch for a model track layout, comprising:

a body part;

a supporting axle coupled to said body part, said supporting axle adapted to be connected to a rail coupler; and a moving mechanism coupled to said body part, said moving mechanism for moving said body part, wherein said supporting axle is configured to be movable relative to said body part, wherein said supporting axle includes a peg extending from an end portion of said supporting axle, said peg adapted to fit within a hole of said rail coupler.

21. A rail converting switch for a model track layout, comprising:

a base;

a sliding part located on said base; and a moving mechanism for moving said sliding part on said base, said moving mechanism including a first and second movable stroke axle coupled to said sliding part, wherein said first and second movable stroke axles move in a same direction, wherein said base includes a peripheral side wall defining an enclosed space, said sliding part and moving mechanism being arranged at least partially within said enclosed space, wherein said base further includes at least one partitioning wall within said enclosed space, said at least one partitioning wall arranged between said sliding part and one of said first and second movable stroke axles.

22. The rail converting switch of claim 21, wherein said sliding part includes a first end and a second end arranged opposite said first end, said first movable stroke axle coupled to said first end and said second movable stroke axle coupled to said second end.

23. The rail converting switch of claim 22, wherein a first flange portion extends outward from said first end and a second flange portion extends outward from said second end, said first movable stroke axle attached to said first flange portion and said second movable strobe axle attached to said second flange portion.

24. The rail converting switch of claim 21, wherein said sliding part moves in said same direction.

25. The rail converting switch of claim 21, wherein said moving mechanism further includes a first and second solenoid for moving said first and second movable stroke axle, respectively.

26. The rail converting switch of claim 25, wherein said first solenoid is positioned in a first direction and said second solenoid is positioned in a second direction opposite to said first direction.

27. A rail converting switch for a model track layout, comprising:

a base;

a sliding part located on said base; and a moving mechanism for moving said sliding part on said base, said moving mechanism including a first and second movable stroke axle coupled to said sliding part, wherein said first and second movable stroke axles move in a same direction, wherein said moving mechanism further includes a first and second solenoid for moving said first and second movable stroke axle, respectively, wherein said first and second solenoid each include a hollow interior, said rail converting switch configured such that said first movable stroke axle moves into the hollow interior of said first solenoid as said second movable stroke axle moves out of said hollow interior of said second solenoid.

* * * * *